United States Patent [19]

Wedin et al.

[11] Patent Number: 5,061,344

[45] Date of Patent: Oct. 29, 1991

[54] METHOD OF MAKING SOFT PAPER

[75] Inventors: Irene K. Wedin, Sundsvall; Bo R. Ek, Stockholm, both of Sweden

[73] Assignee: Sunds Defibrator Aktiebolag, Sweden

[21] Appl. No.: 339,617

[22] PCT Filed: Sep. 22, 1987

[86] PCT No.: PCT/SE87/00424

§ 371 Date: Mar. 14, 1989

§ 102(e) Date: Mar. 14, 1989

[87] PCT Pub. No.: WO88/02416

PCT Pub. Date: Apr. 7, 1988

[30] Foreign Application Priority Data

Oct. 2, 1986 [SE] Sweden ..... 8604190

[51] Int. Cl.[5] ..... D21F 11/00

[52] U.S. Cl. ..... 162/129; 162/123; 162/125; 162/201; 264/112; 264/113; 264/121

[58] Field of Search ..... 162/201, 123, 129, 111, 162/112, 125; 264/121, 113, 112

[56] References Cited

U.S. PATENT DOCUMENTS

| | | | |
|---|---|---|---|
| 2,057,166 | 10/1936 | Schur | 264/121 |
| 2,881,072 | 4/1959 | Clark | 162/201 |
| 2,913,365 | 11/1959 | Osborne et al. | 162/201 X |
| 4,464,224 | 8/1984 | Matolesy | 162/100 X |
| 4,486,268 | 12/1984 | Nuttall et al. | 162/201 X |

*Primary Examiner*—David A. Simmons
*Assistant Examiner*—Thi Dang
*Attorney, Agent, or Firm*—Lerner, David, Littenberg, Krumholz & Mentlik

[57] ABSTRACT

Soft paper from cellulose fibres is manufactured by wet-forming a first fibre layer. Thereafter air-borne dry fibres are deposited directly on one or both sides of the wet-formed layer while this is still wet, so that a second and possibly a third fibre layer are formed on the first one. Fibre bindings thereby arise between the layers. The wet-formed fibre layer gives the soft paper its strength, while the dry-formed fibers give a soft surface.

13 Claims, 1 Drawing Sheet

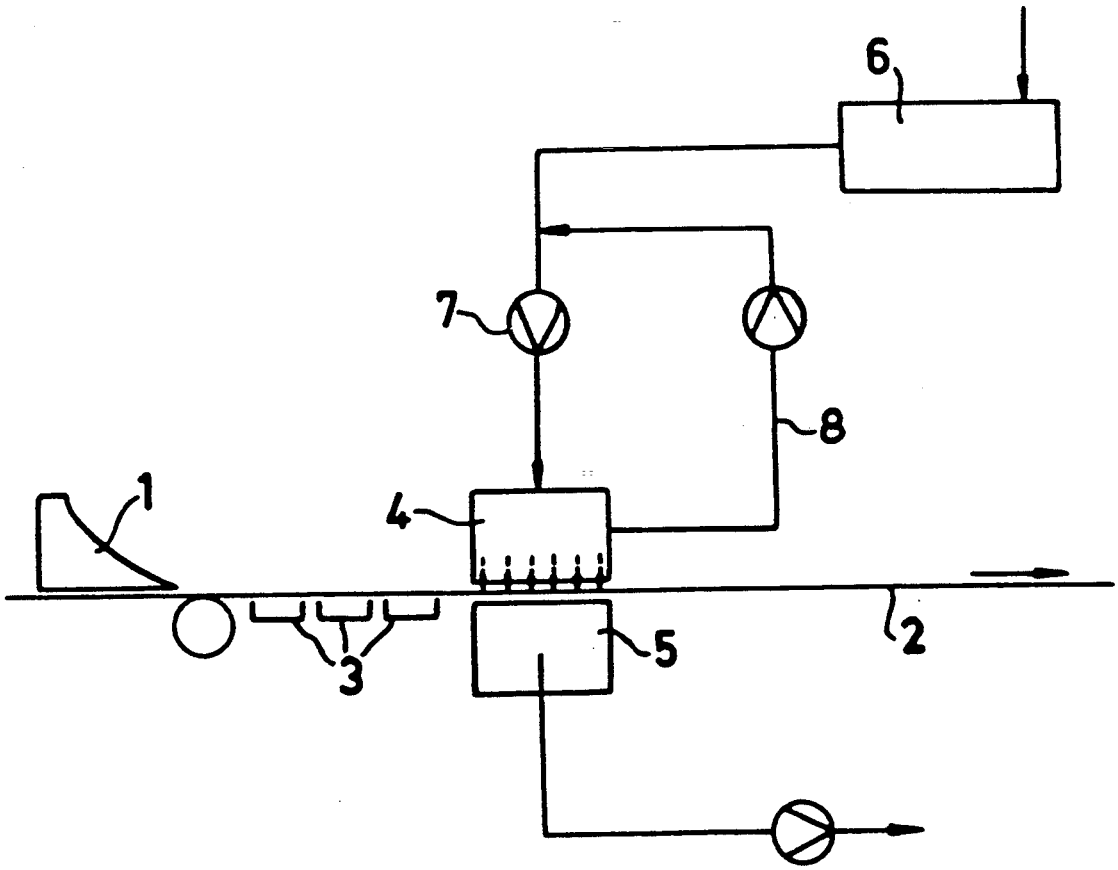
6
7
8
1
4
2
3
5

METHOD OF MAKING SOFT PAPER

FIELD OF THE INVENTION

The present invention relates to the field of making soft paper from cellulose fibers and to apparatus and methods for making soft paper products.

BACKGROUND OF THE INVENTION

Amongst those in the paper industry the term "soft paper" is commonly given to a particular grade of paper used for absorbing purposes, such as tissues, drying cloths, paper toweling, napkins and handkerchiefs. These paper products, unlike their woven fabric counterparts, are intended for disposable use. Thus, while both paper and woven products desirably have rapid and effective absorption, soft feel, smooth structure, and good strength in both dry and wet states, it is the peculiar challenge of the paper industry to provide products embodying these characteristics at a price which makes their one-time use cost-effective.

The bulk of soft paper is manufactured by wet-forming. Wet-forming involves the use of a fiber suspension, usually in water, which is placed on a running wire or conveyor belt and subsequently dewatered and dried. High speed machines which acquire speeds of between 500 and 2,000 m/min. are commonly used, and a grammage between about 20 and about 30 g/m$^2$ is also common. In addition, the wet-formed paper is generally creped, usually by means of a so-called "Yankee cylinder," from which the paper web is scraped off after drying. Creping provides the paper with the necessary extensibility and softness.

Another method of forming soft paper is dry-forming. In dry-forming, dry paper-making pulp is fluffed to form fibers which are suspended in air. The air-borne fibers, without addition of water or other solvent, are deposited on an air pervious wire, and these fibers are bound together by means of a suitable chemical binding agent or agents which are added thereto. Because soft paper manufactured in this way is very bulky, i.e., has a very loose structure, the wire speed of dry-forming apparatus must be significantly reduced relative to the speed of wet-forming machines. Production rates of about 50 m/min. are common. As expected, manufacturing costs are very high because of the low throughput and cost of expensive binders. Consequently, paper manufactured by dry-forming is higher priced and occupies an uncompetitive position in the market place.

This is not to say, however, that price is the only consideration when choosing between soft paper manufactured by wet- and dry-forming. Dry-formed soft paper is a higher bulk than wet-formed paper. This results in a soft and smooth surface more pleasing to the touch. The reason for the higher bulk is that dry-formed paper fibers have not been softened in water and have not been bent down into the plane of the paper, nor have capillary forces been work during the removal of water therefrom. In contrast, wet-formed soft paper is stronger because of the amount of fiber binding which takes place when the fibers are in suspension and as they are dewatered. Furthermore, this strength is obtained without the necessity of additional binding agents which are required by dry-forming soft paper.

Despite significant improvements in the paper-making technology, a paper product having the softness of a dry-formed soft paper and the strength of a wet-formed soft paper, without the required use of expensive binding agents has gone unrealized.

It is therefore an object of the present invention to provide a soft paper product which has the softness of dry-formed paper and the strength and resiliency of wet-formed paper without binders.

It is also an object of the present invention to provide a method for forming a soft paper product having the softness of dry-formed soft paper and the strength of wet-formed soft paper, but without the use of binding agents.

It is further an object of the present invention to provide an apparatus for the production of a soft paper which has the strength of wet-formed soft paper and yet has the softness characteristic of dry-formed soft paper.

SUMMARY OF THE INVENTION

In accordance with one aspect of the present invention, there is provided a soft-paper article which includes a wet-formed layer of fiber material having a first and a second surface and a first dry-formed layer of fiber deposited upon the first surface of the wet-formed layer.

In accordance with another aspect of the present invention, there is provided a process for manufacturing soft paper from fibrous materials which includes the steps of wet-forming a first fiber layer, and depositing dry fibers on at least one surface of the first fiber layer such that a first dry-formed layer of dry fibers is fused and formed thereon.

In accordance with another aspect of the present invention, an apparatus is provided for making soft paper articles which includes a means for providing a suspension of wet fiber material to a running wire such that a first fiber layer is formed, at least one vacuum source arranged along the running wire disposed to at least partially dewater the first fiber layer and means for providing and depositing dry fibers onto at least one side of the first fiber layer.

The present invention is a combination of wet-forming and dry-forming technology whereby the advantages of both technologies are realized without the disadvantages that plague each. According to the present invention, air-borne fibers are deposited directly on a wet-formed layer while that layer is still wet. Between the two layers of fiber, binding takes place which ensures good cohesion of the layers and yield a particularly advantageous quality of soft paper. In a particularly preferred embodiment an additional layer of air-borne dry fibers is deposited on a second side of the wet-formed layer such that a sandwich construction is realized.

BRIEF DESCRIPTION OF THE DRAWINGS

Preferred embodiments of the present invention will be described in greater detail with reference to the accompanying drawing, wherein like members bear like reference numerals and wherein:

FIG. 1 is a diagrammatic view of the apparatus of the present invention.

DETAILED DESCRIPTION

Owing to the invention, the manufactured soft paper has a soft and smooth surface, higher bulk than wet-formed paper, and higher strength than dry-formed paper without the addition of chemical binding agents, softeners, adjuvants, etc. In addition, the soft paper product of the present invention has a high internal bond strength in spite of the absence of special binding agents.

In a preferred embodiment, the soft paper product of the present invention comprises a wet-formed layer of fiber material having a first and a second side and a first dry-formed layer of fiber material deposited upon at least one of the surfaces of the wet-formed layer of fiber material. The dry-formed layer should not be too thick and preferably every dry-formed fiber should be placed in intimate contact with the wet-formed layer, and a grammage of between about 2 and about 20 g/m$^2$ is preferred. While the sources of fiber material for both the wet-formed and dry-formed layers is variable, dry fibers taken from chemical pulp have been found to yield a surface of superior softness. The wet-formed layer should have a grammage of between about 10 and about 100 g/m$^2$.

In a particularly preferred embodiment, the soft paper also contains a second dry-formed layer, falling within the description above, which is deposited upon a second surface of the wet-formed layer forming a sandwich thereof. It is not necessary that the paper products of the present invention be limited thereto. If a higher degree of thickness and/or strength is required, without sacrifice of the softness, repeating layers of wet-formed and dry-formed fiber material may be alternatively stacked and formed as described. In another embodiment, several layers of wet-formed fiber material are bound together and a layer of dry-formed fiber material is provided on each side of the plurality of wet-formed fiber layers.

According to another preferred embodiment of the present invention, a process is provided for manufacturing soft paper. The process involves wet-forming a first fiber layer and depositing dry fibers upon at least one surface of the first fiber layer such that a first dry-formed layer of dry fibers is fussed and formed thereon. In accordance with this process, a suspension of fibers, and preferably an aqueous suspension of fibers, is deposited onto a running wire and shaped as necessary to form a wet-formed layer, web, sheet, or non-woven mat. The wet-formed layer may, in a particularly preferred embodiment, be at least partially dewatered through use of a suction means prior to the application of dry fibers. At the time of the application of air-borne dry fibers, and in accordance with a particularly preferred embodiment, the wet-formed layer will have been dewatered to a dry solids content of between about 5 and 25%. The air-borne dry fibers are then deposited directly onto at least one side of the wet-formed layer, while it is still wet. These dry fibers thereby form a second fiber layer on the first fiber layer with binding occurring as a matter of natural consequence therebetween. The dry fibers are generally those exposed in a defibering device, such as, for example, handmill or coarse shredder, which are then refined by fluffing and transported to the first, wet-formed layer for deposition.

According to another preferred embodiment of the present invention, an apparatus for making soft paper is provided. The apparatus includes a means for providing suspension of wet fiber material to a running wire such that a first fiber layer is formed, at least one vacuum source arranged along said running wire exposed to at least partially dewater said first fiber layer, and means for providing and depositing dry fibers onto at least one side of said first fiber layer. The components for this apparatus are commonly known and used in the production of both wet- and dry-formed soft paper. However, to the applicants' knowledge, the technologies of the two apparatus have never been combined.

According to the present invention, a means for providing a suspension of wet fiber material to a running wire such that a first fiber layer is formed can include a head box and traditional wire or conveyor. In a particularly preferred embodiment, a paper making machine having an air-pervious wire is used. The apparatus will also include at least one vacuum source arranged along the running wire and exposed to at least partially dewater the wet-formed fiber layer. This can be accomplished through traditional suction boxes located beneath the wire. Finally, a means for providing and depositing dry fibers onto at least one side of the first fiber layer is provided. These dry fibers are deposited on the wet-formed layer by means of a forming box which is located above the wire and a vacuum box located beneath the wire. The dry fibers are exposed in a defibering device which can be, for example, hammermill or coarse shredder followed by a refiner for fluffing. The fibers are transported by means of a fan to a forming box mentioned above, which can be of the type shown in Swedish Patent Application 85.059186. Rejected discharge from the forming box can be recycled through a conduit after renewed defibering. Subsequently, a means for drying the soft paper product may be provided.

The present invention may be better understood by reference to the following embodiment which is merely an illustration of a preferred embodiment.

From a head box 1, a fiber suspension flows out onto a running wire 2 thereby forming a first fiber, wet fiber layer. The wire transports the wet-formed layer to suction boxes 3 located beneath the wire 2 whereby dewatering takes place. Subsequently, the wet-formed, partially dewatered layer is transported on the wire 2 to a location between the forming box 4 located above the wire 2 and a vacuum box 5 located beneath the wire 2. At this point air-borne dry fibers are deposited directly on the wet-formed layer through the forming box 4. These dry fibers thereby form a second fiber layer on the first, wet-formed layer. The dry fibers may be exposed, as described previously, in a defibering device 6, for example a hammermill or coarse shredder, followed by a refiner for fluffing. The fibers are transported by means of a fan 7 to the forming box 4. Rejected discharge from the forming box 4 can be transported through conduit 8 and recycled.

At the dry-forming stage, the dry fiber shall be well dispersed in air. For insuring this, the flow rate in the inlet to the forming box shall exceed 100 m/s. The distribution between the rejection flow through conduit 8 and the fiber flow dry-formed on the wet-formed layer shall be such that between about 25 and 100% of the incoming fibers are deposited directly on the wet-formed layer. When the dry fibers adhere to the wet-formed layer, the flow rate can be lower than 10 m/s, as the fiber concentration in air should not exceed about 10%.

FIG. 1 illustrates forming on a fourdrinier wire. However, alternately, forming can be carried out by means of a twin wire, in such a way that the dry fibers are deposited when one wire has left the wet-formed layer.

In a particularly preferred embodiment, a second apparatus is provided for forming soft paper with dry-formed fiber layers on both sides of the wet-layer. Dry fibers can be deposited on one side of the wet-formed layer while it is on the forming wire. Thereafter, the web thus formed is transferred to a second wire whereby dry fibers are deposited on the rear or on a second side of the wet-formed layer while it is still wet so that a third fiber layer is formed upon the wet-formed layer. A sandwich construction thus results.

The principles, preferred embodiments, and modes of operation of the present invention have been described in the foregoing specification. The invention which is intended to be protected herein, however, is not to be construed as limited to the particular embodiments disclosed, since these are to be regarded as illustrative rather than restrictive. Variations and changes may be made by others without departing from the spirit and scope of the invention.

We claim:

1. A process of manufacturing soft paper from cellulosic fibrous material comprising the steps of wet forming a first cellulosic fiber layer, and depositing an amount of dry cellulosic fibers on at least one surface of said first cellulosic fiber layer such that a first dry-formed layer of dry cellulosic fibers having a grammage of between about 2 and 20 g/m$^2$ is fused and formed thereon, and substantially every cellulosic fiber in said first dry-formed layer is in contact with said first cellulosic fiber layer.

2. The process of claim 1 further comprising the step of partially dewatering said wet-formed first fiber layer prior to said depositing of said dry fibers thereon.

3. The process of claim 2 wherein said dewatering of said wet-formed first fiber layer is carried out to a dry solids content of between about 5 and about 25%, prior to said depositing of said dry fibers therein.

4. The process of claim 1 including wet-forming said first fiber layer at a rate of between about 500 and 2000 m/min.

5. The process of claim 1 including wet-forming said first fiber layer so that it has a grammage of about 10 to about 100 g/m$^2$.

6. The process of claim 1 wherein said depositing of said dry fibers is carried out in a stream of air.

7. The process of claim 1 including depositing a second layer of dry-formed fibers on said wet-formed first fiber layer to a grammage of between about 2 and about 20 g/m$^2$.

8. The process of claim 1 including wet-forming said first fiber layer on a running fourdrinier wire.

9. The process of claim 8 including depositing said dry fibers on said first layer while said first fiber layer is on said wire.

10. The process of claim 1 including depositing said dry fibers on both surfaces of said first fiber layer.

11. A soft paper article comprising a wet-formed layer of cellulosic fiber material having a first and second surface and dry cellulosic fibers deposited directly upon at least said first surface of said wet-formed layer, thereby forming a first dry-formed layer, said first dry-formed layer being sufficiently thin such that substantially every fiber therein is in contact with said wet-formed layer, and said first dry-formed layer having a grammage of between about 2 and about 20 g/m$^2$.

12. The soft paper article of claim 11 wherein said first dry-formed layer comprises dry cellulosic produced from chemical pulp.

13. The soft paper article of claim 11 further comprising a second dry-formed layer of cellulosic fiber deposited upon said second surface of said wet-formed layer.

* * * * *

UNITED STATES PATENT AND TRADEMARK OFFICE

CERTIFICATE OF CORRECTION

PATENT NO. : 5,061,344

DATED : October 29, 1991

INVENTOR(S) : Irene K. Wedin and Bo R. Ek

It is certified that error appears in the above-identified patent and that said Letters Patent is hereby corrected as shown below:

Column 1, line 59, after "been" insert --at--.
Column 3, line 49, after "and" insert --about--.
Column 4, line 68, delete "wet-layer" and insert therefor --wet-formed layer--.
Column 6, line 16, after "first" (first occurrence) insert --fiber--.

Signed and Sealed this

Thirtieth Day of March, 1993

*Attest:*

STEPHEN G. KUNIN

*Attesting Officer*

*Acting Commissioner of Patents and Trademarks*